US007594285B2

(12) United States Patent
Chen et al.

(10) Patent No.: US 7,594,285 B2
(45) Date of Patent: Sep. 29, 2009

(54) BOTTOM FRAME ASSEMBLY FOR A BABY CRIB

(75) Inventors: Shun-Min Chen, Taipei (TW); Zheng-Wen Guo, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 309 days.

(21) Appl. No.: 11/237,509

(22) Filed: Sep. 27, 2005

(65) Prior Publication Data

US 2007/0067906 A1 Mar. 29, 2007

(51) Int. Cl.
*A47D 7/00* (2006.01)

(52) U.S. Cl. ..... 5/99.1; 5/93.1; 248/167

(58) Field of Classification Search ..... 5/99.1, 5/93.1, 98.1; 248/167
See application file for complete search history.

(56) References Cited

U.S. PATENT DOCUMENTS 6,305,037 B1 * 10/2001 Cheng ..... 5/99.1
6,725,475 B1 4/2004 Chen

* cited by examiner

*Primary Examiner*—Fredrick Conley
(74) *Attorney, Agent, or Firm*—Christie, Parker & Hale, LLP.

(57) ABSTRACT

A bottom frame assembly for a baby crib includes pairs of first and second bottom frame rods, and a hub unit that includes stationary and rotary seats. The stationary seat is connected to the first bottom frame rods at diametrically opposite positions of the stationary seat. The rotary seat is mounted rotatably on the stationary seat, and is connected to the second bottom frame rods at diametrically opposite positions of the rotary seat. By adjusting the angular orientation of the rotary seat relative to the stationary seat, the angles formed between adjacent ones of the first and second bottom frame rods can be varied so that the bottom frame assembly can suit the specified length-to-width ratio of the baby crib.

8 Claims, 6 Drawing Sheets

BOTTOM FRAME ASSEMBLY FOR A BABY CRIB

BACKGROUND OF THE INVENTION

1. Field of the Invention The invention relates to a baby crib, more particularly to a bottom frame assembly for a baby crib.

2. Description of the Related Art

Referring to FIG. 1, a conventional bottom frame assembly. 5 for a baby crib is shown to include a cross-shaped coupler 51 and four bottom frame rods 52. Each of the bottom frame rods 52 has one end fixed to the coupler 51, and an opposite end connected to a corresponding upright support rod (not shown) of the baby crib.

In the aforementioned bottom frame assembly 5, the coupler 51 is an integrally formed component that does not permit adjustments in the angles formed between adjacent ones of the bottom frame rods 52. Thus, when it is desired to manufacture baby cribs having different length-to-width ratios, manufacturers must prepare different specifications of the couplers 51 to suit the different length-to-width ratios.

SUMMARY OF THE INVENTION

Therefore, the object of the present invention is to provide a bottom frame assembly that is suitable for application to baby cribs having different length-to-width ratios.

According to the present invention, a bottom frame assembly for a baby crib comprises a pair of first bottom frame rods, a pair of second bottom frame rods, and a hub unit. The hub unit includes a stationary seat connected to the first bottom frame rods at diametrically opposite positions of the stationary seat, and a rotary seat mounted rotatably on the stationary seat and connected to the second bottom frame rods at diametrically opposite positions of the rotary seat.

Preferably, the bottom frame assembly further includes a positioning mechanism for locking releasably the rotary seat at a desired angular orientation relative to the stationary seat.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
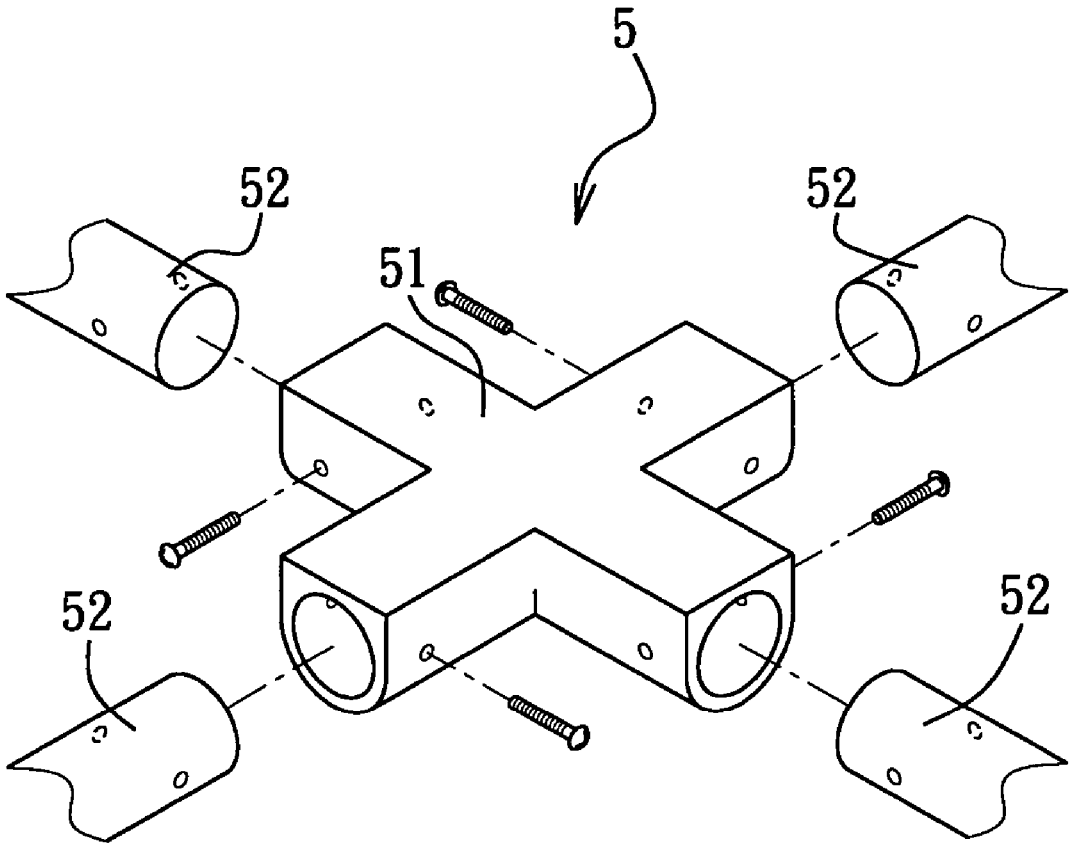
F I G. 1 PRIOR ART
FIG. 1 is a fragmentary exploded perspective view of a conventional bottom frame assembly for a baby crib.
Figure 2:
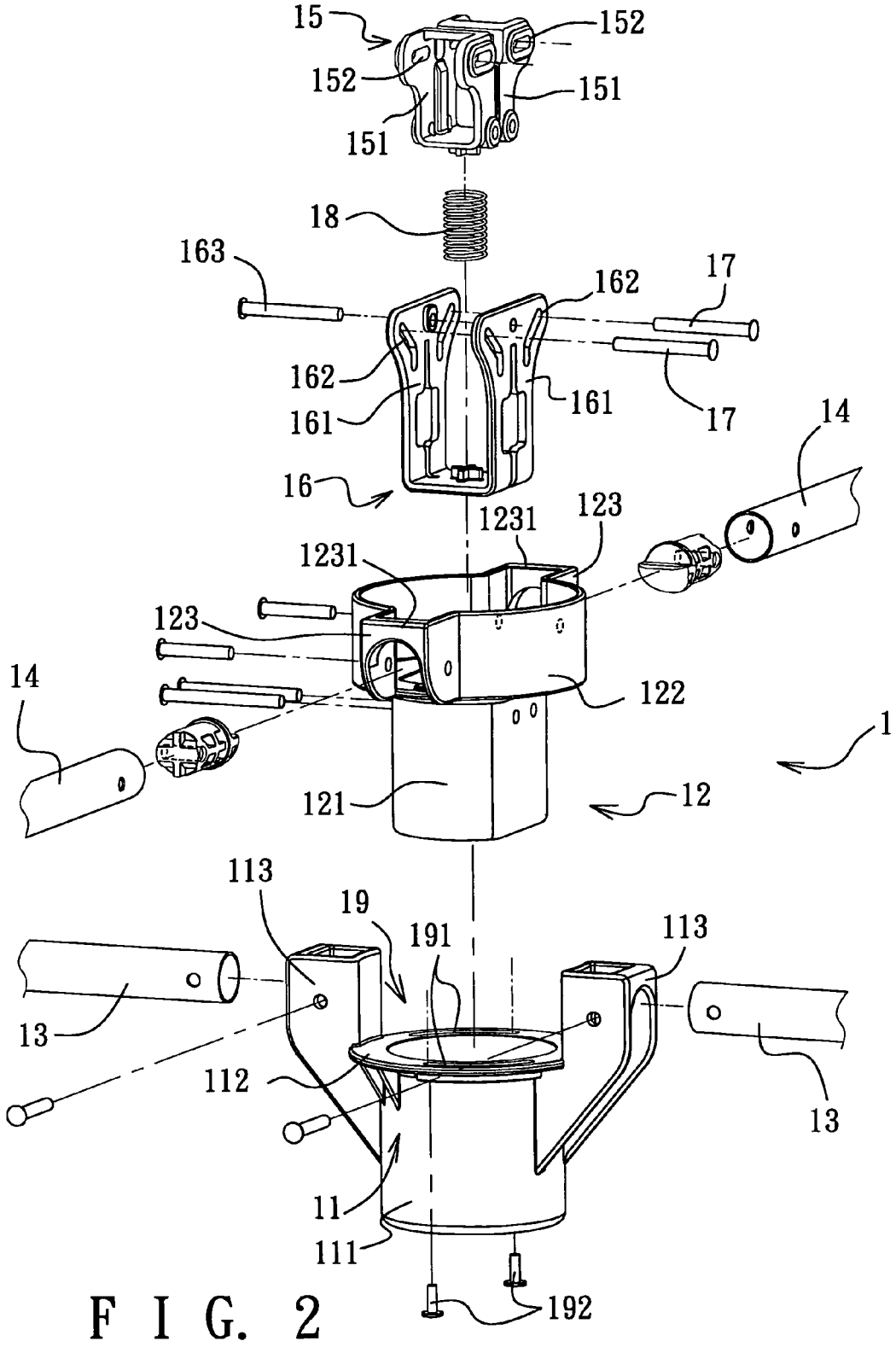
FIG. 2 is a fragmentary exploded perspective view of the preferred embodiment of a bottom frame assembly for a baby crib according to the present invention.
Figure 3:
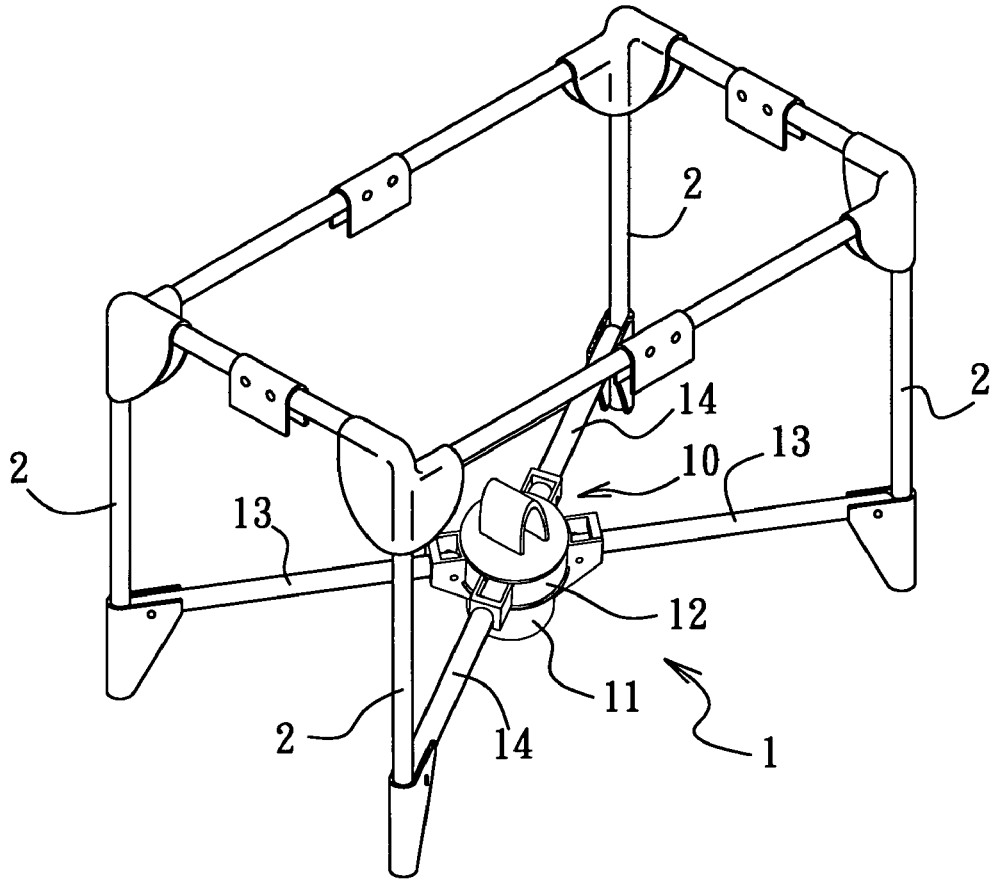
FIG. 3 is a perspective view of a baby crib that incorporates the preferred embodiment of this invention.
Figure 4:
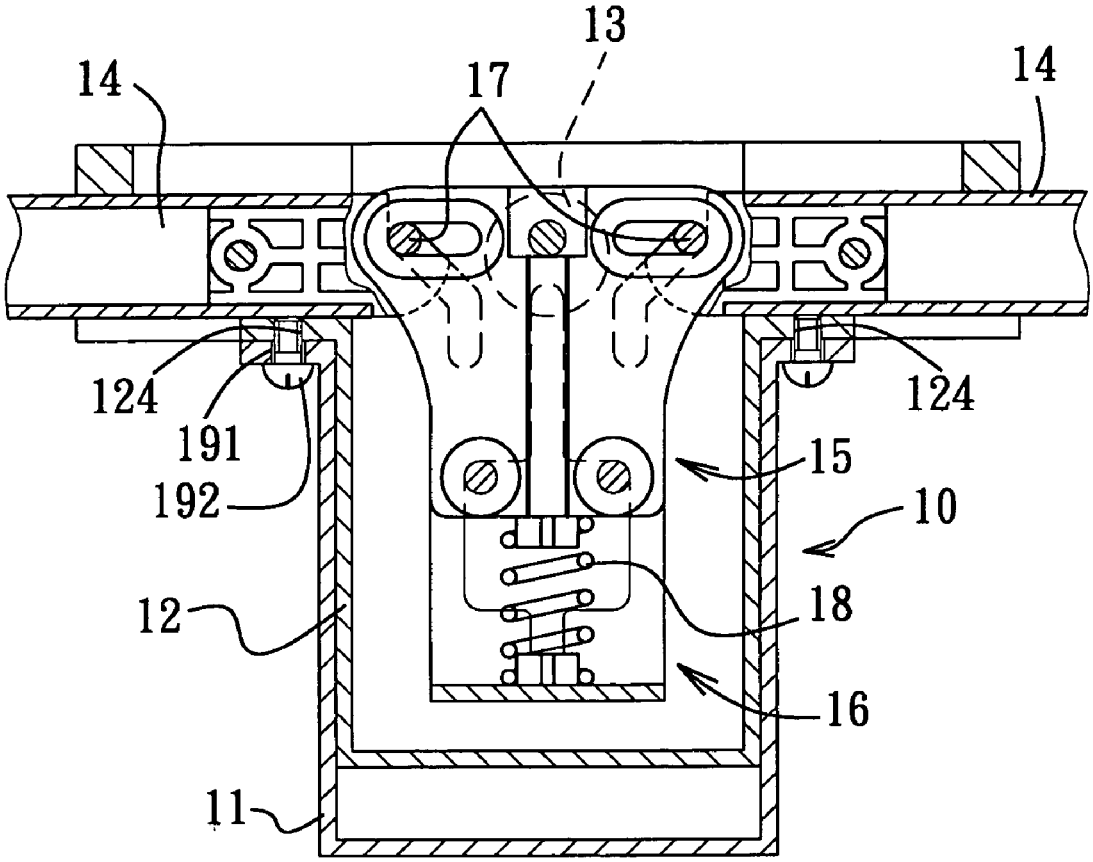
FIG. 4 is a fragmentary schematic sectional view of the preferred embodiment.

Referring to FIGS. 2 to 4, the preferred embodiment of a bottom frame assembly 1 according to the present invention is shown to be adapted for application to a baby crib that includes two pairs of upright support rods 2. The bottom frame assembly 1 includes a hub unit 10 and pairs of first and second bottom frame rods 13, 14.

The hub unit 10 includes a hollow stationary seat 11, a hollow rotary seat 12 that is mounted rotatably on the stationary seat 11, and a positioning mechanism 19 for locking releasably the rotary seat 12 at a desired angular orientation relative to the stationary seat 11 so as to suit a specified length-to-width ratio of the baby crib.

The stationary seat 11 includes a cylindrical seat body 111 that opens upwardly, a coupling flange 112 that extends in radial outward directions from a top end of the seat body 111, and a pair of first pivot arms 113 that are provided on an outer wall surface of the seat body 111 at diametrically opposite positions, respectively. The first pivot arms 113 are reverse U-shaped. Each of the first bottom frame rods 13 has one end connected pivotally to a respective one of the first pivot arms 113, and can pivot downwardly relative to the respective first pivot arm 113.

The rotary seat 12 includes a mounting portion 121 that is disposed rotatably in the stationary seat 11. Preferably, the mounting portion 121 has a pair of curved sides that are rotatable within the seat body 111. The rotary seat 12 further includes a rod connecting portion 122 that is disposed above the mounting portion 121, that has a horizontal cross-section larger than that of the mounting portion 121, and that is seated on the coupling flange 112 of the stationary seat 11. The rod connecting portion 122 is formed with a pair of second pivot arms 123 that project radially, outwardly and respectively from diametrically opposite positions of the rod connecting portion 122. Each of the second pivot arms 123 has a stop edge 1231 and opens downwardly. Each of the second bottom frame rods 14 has one end connected pivotally to a respective one of the second pivot arms 123, and can pivot downwardly relative to the respective second pivot arm 123.

As shown in FIG. 3, each of the first and second bottom frame rods 13, 14 has a distal end remote from the hub unit 10 and connected to a respective one of the upright support rods 2.

The positioning mechanism 19 includes a pair of arc-shaped fastener slots 191 and a pair of fasteners 192. In this embodiment, the fastener slots 191 are formed respectively in diametrically opposite positions of the coupling flange 112 and extend along the coupling flange 112. When it is desired to lock the rotary seat 12 at a desired angular orientation relative to the stationary seat 11, the fasteners 192 are extended respectively through the fastener slots 191 to engage respectively a pair of fastener holes 124 (see FIG. 4) formed in an underside of the second pivot arms 123.

The range of angular adjustment for the rotary seat 12 can be controlled via the length of the fastener slots 191. That is, when the fastener slots 191 are longer, the range of angular adjustment for the rotary seat 12 becomes wider. In other embodiments of this invention, the fastener slots 191 can be formed instead in the rod connecting portion 122 of the rotary seat 12. The fasteners 192 are then extended through the fastener slots 191 to engage corresponding fastener holes (not shown) in the coupling flange 112 of the stationary seat 11.

Figure 5:
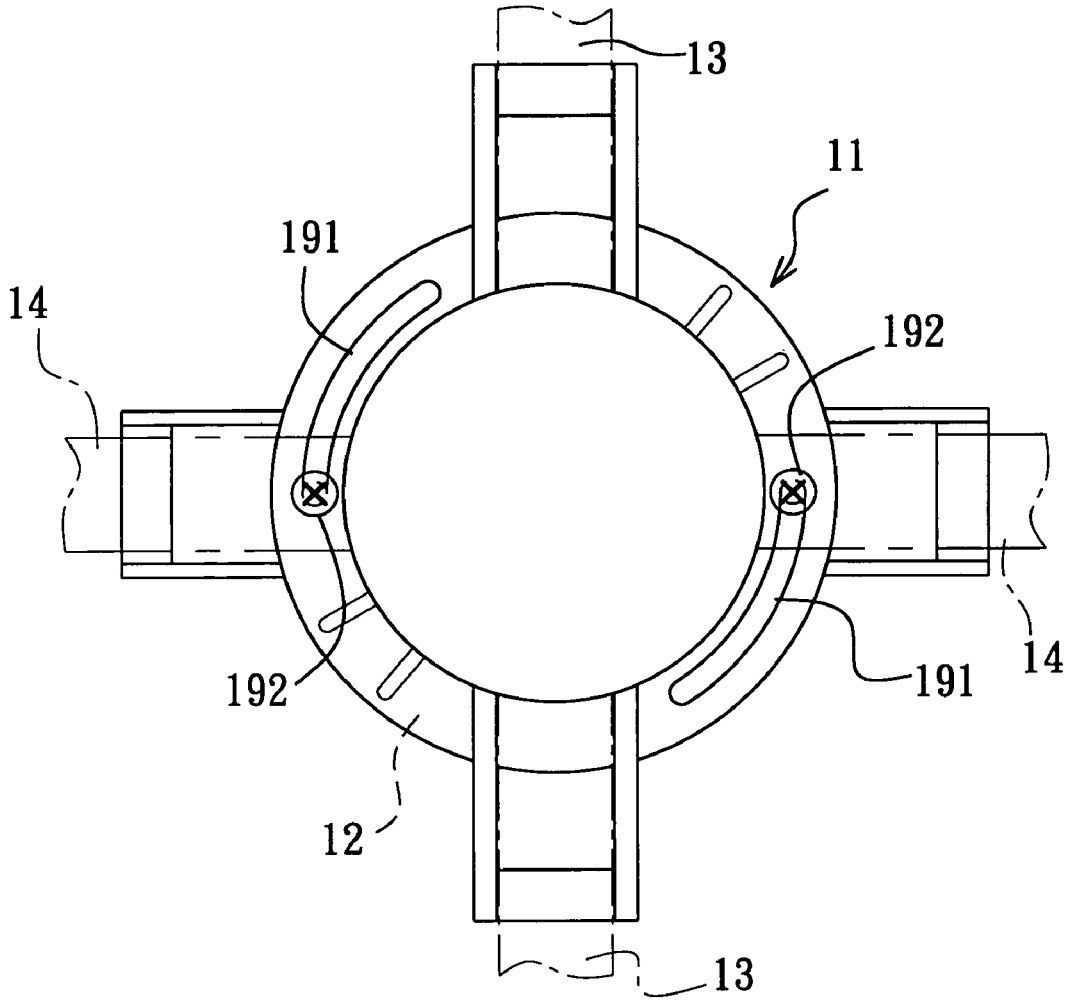
FIG. 5 is a fragmentary schematic bottom view to illustrate an initial position relationship among bottom frame rods of the preferred embodiment.
Figure 6:
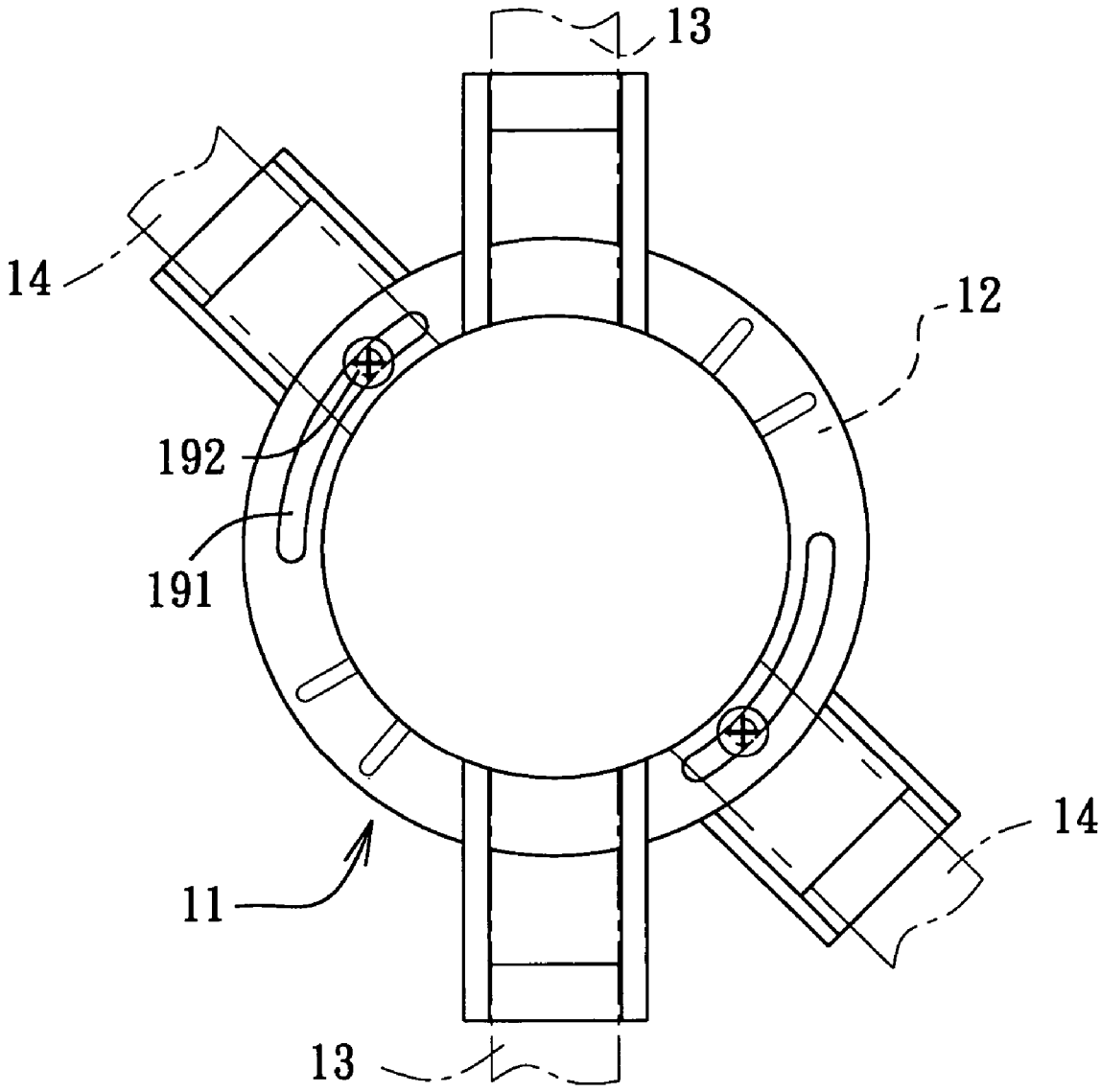
FIG. 6 is a view similar to FIG. 5, but illustrating an adjusted position relationship among the bottom frame rods of the preferred embodiment.

Referring to FIGS. 5 and 6, when assembling the bottom frame assembly 1, it is necessary to adjust the angular orientation of the rotary seat 12 relative to the stationary seat 11 according to the specified length-to-width ratio of the baby crib. FIGS. 5 and 6 respectively illustrate initial and adjusted positions of the rotary seat 12 relative to the stationary seat 11. It is evident that, by varying the angular orientation of the rotary seat 12 relative to the stationary seat 11, the angles formed between adjacent ones of the first and second bottom frame rods 13, 14 can be varied as well so that the bottom frame assembly 1 can suit the specified length-to-width ratio of the baby crib.

In this embodiment, the bottom frame assembly 1 further includes a folding control mechanism for the second bottom frame rods 14. Referring once again to FIGS. 2 and 3, the folding control mechanism is of the type disclosed in U.S. Pat. No. 6,725,475, and includes a stop component 15 and a hollow movable component 16 that receives the stop component 15 therein. The stop component 15 is fixed in the rotary seat 12, and includes a parallel pair of first side walls 151, each of which is formed with a pair of horizontal slots 152. The movable component 16 includes a parallel pair of second side walls 161, each of which is formed with a pair of inclined slots 162. The second side walls 161 are disposed on outer sides of the first side walls 151, respectively. Each of a pair of rivets 17 extends through an aligned pair of the horizontal slots 152 in the first side walls 151 and an aligned pair of the inclined slots 162 in the second side walls 161. A biasing member 18, such as a compression spring, is provided between the stop component 15 and the movable component 16 to bias the movable component 16 away from the stop component 15 such that the rivets 17 are normally disposed in top portions of the inclined slots 162. When the rivets 17 are disposed in the top portions of the inclined slots 162, they are disposed farther apart from each other and extend respectively above distal ends of the second bottom frame rods 14 to arrest downward pivoting movement of the same relative to the rotary seat 12. A pull pin 163 extends between the second side walls 161 of the movable component 16 for connection to a pull strap (see FIG. 3). When it is desired to fold the second bottom frame rods 14, a pulling force is exerted on the pull strap, thereby moving the movable component 16 upward relative to the stop component 15 against the biasing action of the biasing member 18. At this time, the rivets 17 are moved into bottom portions of the inclined slots 162, and are moved closer to each other. When moved into the bottom portions of the inclined slots 162, the rivets 17 cease to abut against the distal ends of the second bottom frame rods 14, thereby permitting downward pivoting movement of the second bottom frame rods 14 relative to the rotary seat 12.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A bottom frame assembly for a baby crib, comprising a pair of first bottom frame rods, a pair of second bottom frame rods, and a hub unit that includes a stationary seat connected to said first bottom frame rods at diametrically opposite positions of said stationary seat, and a rotary seat mounted rotatably on said stationary seat and connected to said second bottom frame rods at diametrically opposite positions of said rotary seat, wherein rotation of said rotary seat around a longitudinal axis of said rotary seat relative to said stationary seat moves said second bottom frame rods around said longitudinal axis relative to said first bottom frame rods to vary the angles between adjacent ones of said first and second bottom frame rods.

2. The bottom frame assembly for a baby crib as claimed in claim 1, further comprising a positioning mechanism for locking releasably said rotary seat at a desired angular orientation relative to said stationary seat.

3. The bottom frame assembly for a baby crib as claimed in claim 2, wherein said positioning mechanism includes a fastener slot formed in one of said stationary and rotary seats, and a fastener that extends through said fastener slot and that engages the other one of said stationary and rotary seats.

4. The bottom frame assembly for a baby crib as claimed in claim 2, wherein said stationary seat includes:

a cylindrical seat body that opens upwardly and that has a top end and an outer wall surface;

a coupling flange that extends in radial outward directions from said top end of said seat body; and a pair of first pivot arms that are provided respectively on said outer wall surface of said seat body at said diametrically opposite positions of said stationary seat;

each of said first bottom frame rods having one end connected pivotally to the respective one of said first pivot arms.

5. A bottom frame assembly for a baby crib, comprising:

a pair of first bottom frame rods;

a pair of second bottom frame rods;

a hub unit that includes a stationary seat connected to said first bottom frame rods at diametrically opposite positions of said stationary seat, and a rotary seat mounted rotatably on said stationary seat and connected to said second bottom frame rods at diametrically opposite positions of said rotary seat; and a positioning mechanism for locking releasably said rotary seat at a desired angular orientation relative to said stationary seat;

wherein said positioning mechanism includes a fastener slot formed in one of said stationary and rotary seats, and a fastener that extends through said fastener slot and that engages the other one of said stationary and rotary seats; and wherein said fastener slot is arc-shaped and is formed in said stationary seat.

6. A bottom frame assembly for a baby crib, comprising:

a pair of first bottom frame rods;

a pair of second bottom frame rods;

a hub unit that includes a stationary seat connected to said first bottom frame rods at diametrically opposite positions of said stationary seat, and a rotary seat mounted rotatably on said stationary seat and connected to said second bottom frame rods at diametrically opposite positions of said rotary seat; and a positioning mechanism for locking releasably said rotary seat at a desired angular orientation relative to said stationary seat;

wherein said stationary seat includes a cylindrical seat body that opens upwardly and that has a top end and an outer wall surface, a coupling flange that extends in radial outward directions from said top end of said seat body, and a pair of first pivot arms that are provided respectively on said outer wall surface of said seat body at said diametrically opposite positions of said stationary seat, each of said first bottom frame rods having one end connected pivotally to the respective one of said first pivot arms; and wherein said rotary seat includes a mounting portion that is disposed rotatably in said stationary seat, and a rod connecting portion that is disposed above said mounting portion and that is formed with a pair of second pivot arms, said second pivot arms projecting radially, outwardly and respectively from said diametrically opposite positions of said rotary seat;

each of said second bottom frame rods having one end connected pivotally to the respective one of said second pivot arms.

7. A bottom frame assembly for a baby crib, comprising:

a pair of first bottom frame rods;

a pair of second bottom frame rods;

a hub unit that includes a stationary seat connected to said first bottom frame rods at diametrically opposite positions of said stationary seat, and a rotary seat mounted rotatably on said stationary seat and connected to said second bottom frame rods at diametrically opposite positions of said rotary seat; and a positioning mechanism for locking releasably said rotary seat at a desired angular orientation relative to said stationary seat;

wherein said stationary seat includes a cylindrical seat body that opens upwardly and that has a top end and an outer wall surface, a coupling flange that extends in radial outward directions from said top end of said seat body, and a pair of first pivot arms that are provided respectively on said outer wall surface of said seat body at said diametrically opposite positions of said stationary seat, each of said first bottom frame rods having one end connected pivotally to the respective one of said first pivot arms; and wherein said positioning mechanism includes an arc-shaped fastener slot formed in and extending along said coupling flange, and a fastener extended through said fastener slot to engage one of said second pivot arms.

8. A bottom frame assembly for a baby crib, comprising:

a pair of first bottom frame rods;

a pair of second bottom frame rods; and a hub unit that includes a stationary seat connected to said first bottom frame rods at diametrically opposite positions of said stationary seat, and a rotary seat mounted rotatably on said stationary seat and connected to said second bottom frame rods at diametrically opposite positions of said rotary seat;

wherein each of said first bottom frame rods has one end connected pivotally to said stationary seat so as to be pivotable between an extended position and a retracted position;

wherein each of said second bottom frame rods has one end connected pivotally to said rotary seat so as to be pivotable between an extended position and a retracted position; and wherein rotation of said rotary seat around a longitudinal axis of said rotary seat relative to said stationary seat moves said second bottom frame rods around said longitudinal axis relative to said first bottom frame rods to vary the angles between adjacent ones of said first and second bottom frame rods while said first and second bottom frame rods are in their extended positions.

* * * * *